United States Patent [19]

Plewes et al.

[11] 4,387,276

[45] Jun. 7, 1983

[54] CARBON TRANSDUCER WITH ELECTRICAL CONTACT

[75] Inventors: John T. Plewes, Berkeley Heights, N.J.; Nathaniel R. Quick, Indianapolis, Ind.; Murray Robbins, Berkeley Heights, N.J.

[73] Assignee: Bell Telephone Laboratories, Incorporated, Murray Hill, N.J.

[21] Appl. No.: 301,816

[22] Filed: Sep. 11, 1981

[51] Int. Cl.[3] ..... H04R 21/02

[52] U.S. Cl. ..... 179/125; 179/123; 179/128; 179/140; 29/594

[58] Field of Search ..... 179/122, 123, 124, 125, 179/128, 140; 29/594

[56] References Cited

U.S. PATENT DOCUMENTS

| | | | |
|---|---|---|---|
| 2,585,052 | 2/1952 | Skeleton | 179/123 |
| 2,607,859 | 8/1952 | Bryant | 179/124 |
| 4,205,206 | 5/1980 | Eishima et al. | 179/124 |

*Primary Examiner*—G. Z. Rubinson
*Assistant Examiner*—Danita R. Byrd
*Attorney, Agent, or Firm*—George S. Indig

[57] ABSTRACT

A carbon transmitter utilizes an electrode prepared by in situ reaction between substrate copper and introduced sulfur. Good surface adhesion between the resulting CuS layer and the substrate is assured by use of a two-phase cobalt/copper substrate.

6 Claims, 1 Drawing Figure

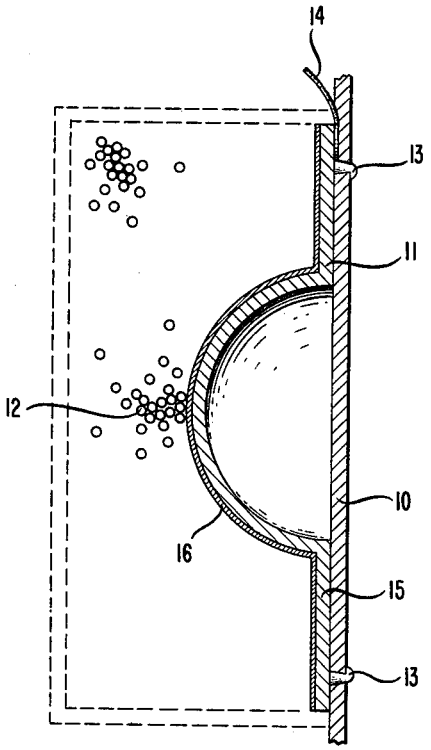
14
13
11
12
10
16
15
13

CARBON TRANSDUCER WITH ELECTRICAL CONTACT

BACKGROUND OF THE INVENTION

1. Field of the Invention

The invention concerns apparatus in which electrical connection is made to a mass of carbon granules and particularly carbon transducers such as microphones and transmitters.

2. Description of the Prior Art

The common telephone handset has for many years depended upon a transmitter in which mechanical vibrations are converted into electrical variations on a carrier current by means of contacting carbon granules. Traditionally, an electrode in this transmitter has consisted of a gold plated contact, often a contact which was first shaped and subsequently electroplated.

Recent severe increases in gold prices have provoked studies designed to replace this gold plated electrode. Many alternatives have been studied, but none has been generally accepted.

For example, substitution of gold by palladium or an alloy of palladium-silver, so promising in so many applications, has failed. Failure of this and other materials is ascribed to attack by a variety of agents present in the hostile environment resulting from sulfur and other gases released by carbon.

An alternative which has proven successful in the instance of certain electrode structures, notably the back electrode in the same transmitter, is not useful. Carbon cannot be shaped and its use would necessitate expensive redesign.

SUMMARY OF THE INVENTION

An electrode of stability sufficient to withstand attack by ambients in an apparatus in which contact is maintained with carbon granules depends upon an in situ formed layer of copper sulfide (CuS) in intimate contact with a substrate. Formation of the layer results from introduction of sulfur, either as a vapor or in nonaqueous solution with a copper-containing substrate. Layers so produced have survived severe testing which involves temperature cycling and high humidity conditions.

The CuS surfaced contact may be structurally similar to a conventional electrode which is produced by deep-drawing and then gold plating a brass sheet. The copper-containing substrate now required may be deep-drawn in the same manner as the brass substrate of the traditional device, and the shaped substrate may be mechanically crimped to a support, again in the same manner as the gold plated detail. Finally the contact layer is produced as reaction product replacing the usual gold electroplating. Apparatus containing a CuS surfaced electrode of this nature constitutes a preferred aspect of the invention.

Contacts of the invention depend for their excellent adherence upon presence of cobalt in amount of at least 8 percent by weight and preferably at least 15 percent by weight in the substrate surface during in situ reaction.

BRIEF DESCRIPTION OF THE DRAWING

The Drawing is a cross-section of a carbon apparatus utilizing an electrode in accordance with the invention.

DETAILED DESCRIPTION

The transmitter portion depicted consists of a flexible membrane 10 which is mechanically clamped to front electrode 11 which, in turn, transmits vibrational energy, into contacting granules 12. Electrode 11 is mechanically crimped to membrane 10 by tangs 13 and is electrically connected to a voltage source not shown by means of conductor 14. Granules 12 contact a back electrode, not shown, similarly provided with electrical connection (not shown) so that a voltage is maintained across the granules in use. In accordance with the invention, electrode 11 consists of a substrate 15 which is primarily copper, but which contains cobalt as a necessary ingredient, with cobalt content sufficient to result in two crystallographic phases, one copper-rich, the other cobalt-rich. Physical contact (and therefore electrical contact) of electrode 11 with particles 12 is via a contact layer 16 which, in accordance with the invention, is an in situ-produced layer consisting essentially of copper sulfide of the stoichiometry CuS.

Compositional Considerations

The electrode of the invention is produced by in situ reaction between a first reactant contained in the substrate and a second reactant which may be introduced in vapor or liquid phase. Adhesion required to withstand distortion in use and, in accordance with the preferred embodiment, to permit fabrication entailing cold working of the substrate attributed to a substrate surface, is defined crystallographically as consisting of two phases, the one copper rich, the other cobalt rich.

The multiphase nature of the substrate surface results from inclusion in the substrate composition of an amount of cobalt which exceeds the solubility limit.

During usual formation, e.g., from a melt or as produced by powder metallurgy, the solubility limit for cobalt in copper cobalt alloy does not exceed 2 to 3 percent by weight of the range. Cobalt content required to assure a level of adhesion considered desirable is at a minimum of 8 percent by weight and preferably at 15 percent. Maximum cobalt content is dictated by a number of considerations: a desire to maintain sufficient ductility to permit deformation of the substrate in fabrication, and ultimately by the need to maintain sufficient copper to produce a continuous CuS-containing layer. From the latter standpoint, cobalt content as high as 35 weight percent is tolerable. For desired ductility to permit fabrication of a particular structure in accordance with the invention, maximum cobalt content is at 25 weight percent and this therefore constitutes a preferred maximum.

Fabrication typically involves formation of the sheet material by cooling from a melt or by powder metallurgy followed by required deformation, e.g., by cold working such as by deep drawing. The history of the sheet prior to drawing may involve one or more paired steps of cold rolling and annealing.

A number of compositional modifications may be introduced. These include addition of selenium and nickel to the substrate. In general, compositional modifications result in some degradation in at least one of the properties chemical stability, adhesion and contact resistance. Accordingly, it is preferred that the substrate surface be at least 99 weight percent copper and cobalt.

It has been observed that formation of the CuS contact layer, under some conditions, entails migration of cobalt to result in as much as 2 weight percent of this element at the layer. Structures tested have included some with cobalt content measured at this level.

While intentional processing variations or compositional variations designed to modify the contact layer during in situ reaction are not generally contemplated, post-treatment may be permitted. For example, analogous to fabrication of other types of contact structures, gold may be diffused in from a free surface.

A preferred embodiment as shown in the FIGURE contemplates formation of an electrode structure by cold deep drawing described as cold working to thickness reduction of at least 25 percent. The corresponding structure as now produced for use in a telephone handset has a brass substrate which is electroplated with a hard gold contact layer. This structure is described as having a drawn dome porton having minimum radius curvature of 0.148 inch.

The preferred embodiment contemplates a structure of the same form and dimensions but in which the contact layer is produced by in situ reaction on the already formed dome structure. In this instance the dome is formed of copper-cobalt alloy as described.

Conditions under which the electrode is qualified for telephone use include temperature cycling and high humidity. One specific set of test conditions is specified in Example 1.

In test, and also in use, carbon granules are known to evolve reactive material, e.g., hydrocarbon or sulfur. Failure of previously tested substitute materials has been attributed to reaction with such evolved material. Contact layers produced in accordance with the invention have withstood this environment.

EXAMPLES

Copper, 20 weight percent cobalt alloy in the numbered example was prepared by vacuum induction melting at a temperature of 1250 degrees C. The ingot as slab cast was of dimensions about 7 inches square by several feet and had a weight of about 700 pounds. The cast slab was hot-rolled at 850 degrees C. to a final slab thickness of 0.5 inch, and to a width of about 18 inches over a period of several minutes during which time the slab was permitted to cool to a temperature of about 650 degrees C. The slab was then scarfed on both sides (50 mil surface thickness was removed from both major surfaces). The scarfed slab was then cold-rolled to a thickness of 0.125 inch, and was then annealed at a temperature of 900 degrees C. for three or four hours in a nonoxidizing atmosphere. Through a succession of consecutive cold rolling and annealing steps, a strip of 0.003 inch was prepared. The sheet was prepared for deep-drawing by a final anneal of 900 degrees C. for 30 minutes $13H_2$ followed by furnace cooling. The final detail was produced by deep-drawing in a consequent stage die to result in an approximately hemispherical structure of the general form shown in the FIGURE.

In Example 1 the domed substrate was grit-blasted and was exposed to sulfur-vapor using nitrogen carrier gas at a temperature of 165 degrees C. for one hour. It was then washed in monochlorobenzene to remove free sulfur. The contact layer as measured on the convex side of the hemispherical contact had a thickness of about 5 micrometers. A series of domes, as so fabricated, were subjected to 144 thermal cycles over temperature limits of 40 degrees C. and +150 degrees C. with each cycle of an approximate duration of 12 hours. Cycling was conducted in a closed system with relative humidity set at 90 percent at a temperature of 90 degrees Fahrenheit. After 144 cycles, no appreciable change in transmitter electro-acoustical properties was observed.

EXAMPLE 1

The electrode, as so fabricated, was placed in a test structure resembling that of the FIGURE. Transmitter-grade carbon granules were in physical contact with the convex surface of the hemisphere. Contact resistance at 100 g load was 4.2 milliohms (mΩ) before testing and still below 10 mΩ after testing.

EXAMPLE 2

An electrode was fabricated as in Example 1, but with the contact layer being produced by reaction with a dichlorobenzene solution containing 7 weight percent sulfur maintained at a temperature of 179 degrees C. for a period of 15 minutes. Contact resistance at 100 g load was 5.2 milliohms before testing, and was below 10 mΩ after testing.

EXAMPLE 3

A hemispherical electrode fabricated as in Example 1 was processed by reaction with molten sulfur at a temperature of 180 degrees C. for a period of 2 hours. Initial contact resistance was about 7.2 mΩ and after testing was below 15 mΩ.

Many other experiments were conducted. Cobalt content within the range of from 8 weight percent to 35 weight percent was found to be acceptable in terms of contact resistance. Other tests involved contact layers produced on substrates prepared by powder metallurgy. An alternative approach which takes advantage of the high layer-to-substrate adhesion involves deforming the coated copper cobalt sheet. In many respects substrate and contact layers upon which this invention depends are described in copending application Ser. No. 301,887.

What is claimed is:

1. Carbon transducer for converting sound waves into electrical impulses comprising a first electrode making physical contact with packed carbon granules, said electrode comprising a metallic substrate having a surface in contact with and supporting a conducting layer

CHARACTERIZED IN THAT the said substrate consists essentially of two phase copper cobalt alloy at the said surface, in that the said conducting layer consists essentially of at least 95 percent by weight copper sulfide of the nominal composition CuS and in which the said layer is produced by in situ reaction of substrate copper with sulfur.

2. Transducer of claim 1 in which the said substrate consists essentially of 99 weight percent of an alloy of copper and sulfur.

3. Transducer of claim 2 in which the said alloy consists of from 8 weight percent cobalt to 35 weight percent cobalt, remainder copper.

4. Transducer of claim 3 in which cobalt content is from 15 weight percent to 25 weight percent.

5. Transducer of claim 1 in which said electrode is fabricated by cold-drawing to shape the said substrate prior to in situ reaction.

6. Transducer of claim 1 in which said electrode is fabricated by cold-drawing to shape the said substrate subsequent to in situ reaction.

* * * * *